US007963810B1

(12) United States Patent
Yang

(10) Patent No.: US 7,963,810 B1
(45) Date of Patent: Jun. 21, 2011

(54) ELECTRICAL CONNECTOR

(75) Inventor: Chih-Lin Yang, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/696,046

(22) Filed: Jan. 28, 2010

(51) Int. Cl.
*H01R 13/502* (2006.01)

(52) U.S. Cl. ..... 439/686

(58) Field of Classification Search ..... 439/660, 439/686, 66, 65, 79
See application file for complete search history.

(56) References Cited

U.S. PATENT DOCUMENTS 6,869,294 B2 * 3/2005 Clark et al. ..... 439/79
7,338,318 B2 * 3/2008 Shen et al. ..... 439/571
7,367,816 B2 * 5/2008 Liu ..... 439/74
7,384,274 B1 * 6/2008 Chen et al. ..... 439/74
7,422,451 B2 * 9/2008 Chen et al. ..... 439/101
7,465,194 B1 * 12/2008 Ho et al. ..... 439/607.01
7,677,919 B1 * 3/2010 Lin ..... 439/500
D615,494 S * 5/2010 Yang ..... D13/120
7,802,994 B1 * 9/2010 Chen et al. ..... 439/65
2009/0142953 A1 * 6/2009 Patel et al. ..... 439/345
2010/0130068 A1 * 5/2010 Peng ..... 439/660

* cited by examiner

*Primary Examiner* — Jean F Duverne
(74) *Attorney, Agent, or Firm* — Cheng-Ju Chiang

(57) ABSTRACT

A battery connector includes a housing and a plurality of contacts. The housing includes a plurality of first slits formed on a front surface, a plurality of through channels extended from the first slits respectively and penetrated a rear surface, a plurality of first fixing channels extended from first slits respectively and towards the rear surface and a plurality of second slits connected to the through channels respectively. The contacts are received in the first slits respectively. Each of the contacts includes a base board, a supporting section extended downwardly the base board, a foot section extended to below the base board, a first fixing section extended from the base board and received in each of the through channels, and a second fixing section extended from the first fixing section and received in each of the second slits of the housing.

4 Claims, 5 Drawing Sheets

ELECTRICAL CONNECTOR

BACKGROUND OF THE INVENTION

1. Field of the Invention

The present invention relates to an electrical connector, more specifically, to a battery connector.

2. The Related Art

Please refer to FIG. 1 and FIG. 2. A conventional battery connector 100' is mounted to a printed circuit board 30'. The printed circuit board 30' has a plurality of soldering holes 31' formed on a surface thereof. The battery connector 100' includes an elongate housing 10' transversely mounted on the surface of the printed circuit board and a plurality of contacts 20' received in the housing 10'.

The housing 10' defines a plurality of slits 111' vertically extended from a top of a front surface and to a bottom surface thereof. A top portion of each of the slits 111' horizontally extended a pair of channels 112' towards a rear surface of the housing 10'. The channels 112' in each of the slits are separated by a rib.

Each of the contacts 20' has a base board 21', a pair of fixing strips 22' horizontally extended from opposite ends of a rear edge of the base board 21', and soldering leg 23' extended downwardly from a rear end of a bottom edge of the base board 21'.

The fixing strips 22' of the contact 20' is fixed in the channels 112'of the housing 10'. The soldering leg 23' of the contact 20' is received in the slit 111' of the housing 10'. The distal end of the soldering leg 23' of the contact 20' is projected from the bottom surface of the housing 10' and inserted into the soldering hole 31' of the printed circuit board 30 for being soldering to the printed circuit board 30'.

Because the soldering leg 23' straight extended downwardly from the rear end of the bottom edge of the base board 21' of the contact 20', the weight of the contact 20' is biased on the base board 21'. Hence, the base board 21' of the contact 20' will slant forwardly. It is hard to assemble the contact 20' to the housing 10. Therefore, the printed circuit board 30' has to form soldering holes 31' for being inserted the soldering legs 23' of the contacts 20' to fix the contacts 20'.

SUMMARY OF THE INVENTION

An object of the present invention is to provide a battery connector.

According to the invention, the battery connector includes a housing and a plurality of contacts received in the housing. The housing includes a plurality of first slits, a plurality of through channels and a plurality of second slits. The first slits are formed on a front surface of the housing. Each of the through channels is extended from each of the first slits, crossed through the housing and penetrated on a rear surface of the housing. Each of the second slits is formed on the rear surface of the housing and connected to each of the through channels.

The contacts are received in the first slits of the housing respectively. Each of the contacts includes a base board, a soldering leg, a first fixing section and a second fixing section. The base board is protruded from the front surface of the housing. The soldering leg is extended from the base board and protruded from the housing. The first fixing section is extended from the base board and received in each of the through channels of the housing. The second fixing section is extended from the first fixing section and received in each of the second slits of the housing.

Another object of the present invention is to provide a battery connector.

According to the invention, the battery connector mounted on a printed circuit board includes a housing and a plurality of contacts received in the housing. The housing includes a plurality of first slits and a plurality of first fixing channels. The first slits are formed on a front surface of the housing. Each of the first fixing channels is extended from each of the first slits and towards a rear surface of the housing.

The contacts are received in the first slits of the housing respectively. Each of the contacts includes a base board, a strip, a supporting section and a foot section. The base board is protruded from the front surface of the housing. The strip is extended from the base board and engaged into each of the first fixing channels. The supporting section is extended downwardly from the base board and received in each of the first slits.

The foot section is extended to below the base board. The foot section of each of the contacts and a bottom surface of the housing are at the same level to be mounted on the printed circuit board, and the foot section and the base board are overlapped in a vertical direction.

Another object of the present invention is to provide a battery connector.

According to the invention, the battery connector mounted on a printed circuit board includes a housing and a plurality of contacts received in the housing. The housing includes a plurality of first slits, a plurality of through channels, a plurality of first fixing channels and a plurality of second slits.

The first slits are formed on a front surface of the housing. Each of the through channels is extended from each of the first slits, crossed through the housing and penetrated on a rear surface of the housing. Each of the first fixing channels is extended from each of the first slits and towards a rear surface of the housing. Each of the second slits is connected to each of the through channels.

The contacts are received in the first slits of the housing respectively. Each of the contacts includes a base board, a supporting section, a foot section, a first fixing section and a second fixing section. The base board is protruded from the front surface of the housing. The supporting section is extended downwardly the base board and received in each of the first slits.

The foot section is extended to below the base board. The first fixing section is extended from the base board and received in each of the through channels of the housing. The second fixing section is extended from the first fixing section and received in each of the second slits of the housing. The foot section of each of the contacts and a bottom surface of the housing are at the same level to be mounted on the printed circuit board, and the foot section and the base board are overlapped in a vertical direction.

According to the first fixing section and the second fixing section of the contact are respectively received in the through channel along a horizontal direction and in the second slit along the vertical direction, the contact is firmly assembled to the housing.

Because the foot section of the contact is extended forwardly and below the base board, the weight of the contact can be shared and supported by the foot section. Because the foot section of the contact is horizontally mounted on the printed circuit board, the contact area between the contact of the battery connector and the printed circuit board can be increased for improving the conductivity therebetween.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
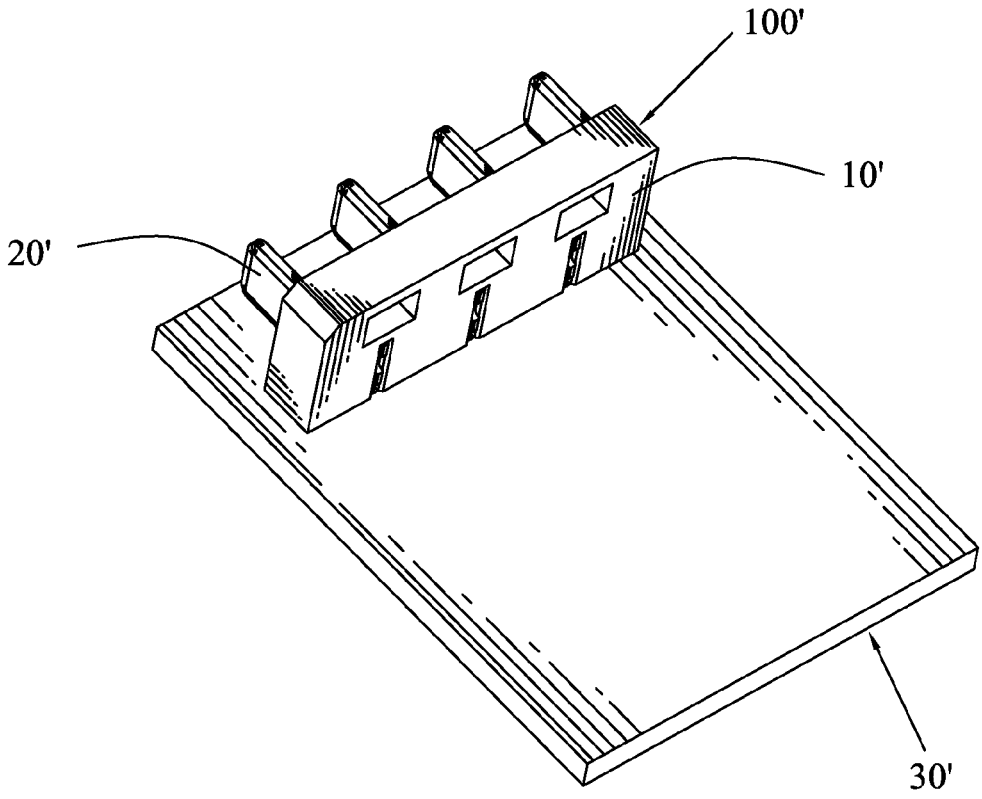
FIG. 1 (PRIOR ART)
FIG. 1 is a perspective view of a conventional battery connector.
Figure 2:
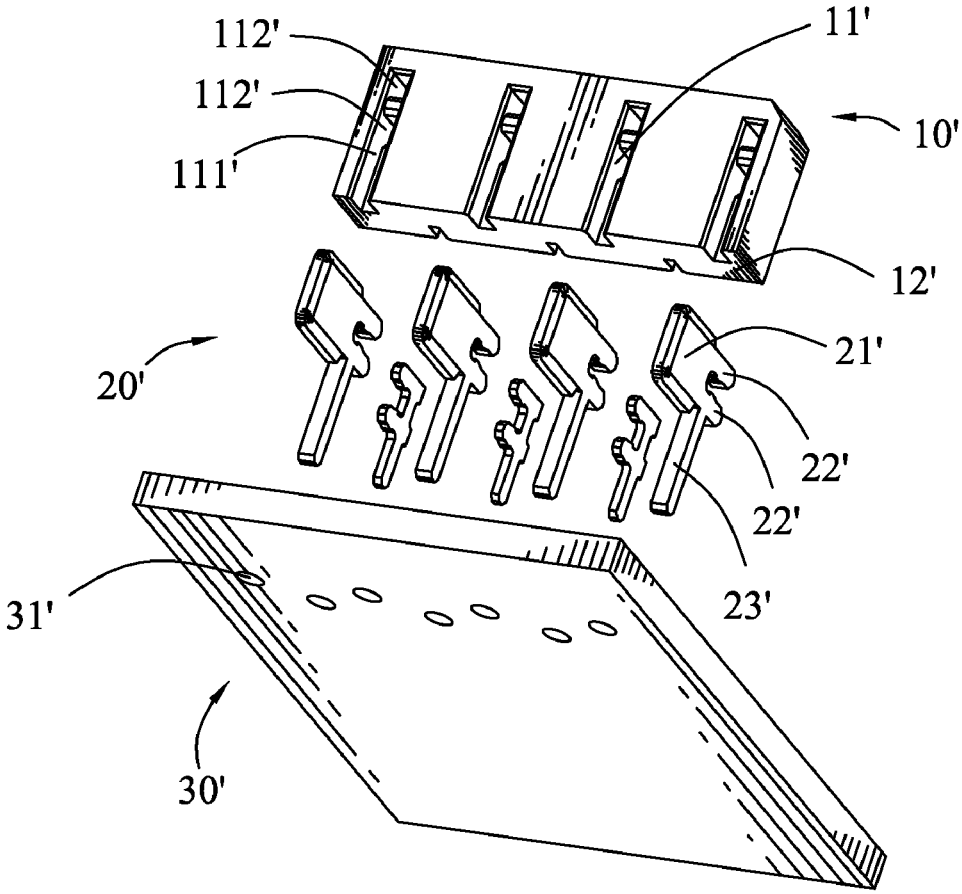
FIG. 2 (PRIOR ART)
FIG. 2 is an exploded view of the conventional battery connector in FIG. 1.
Figure 3:
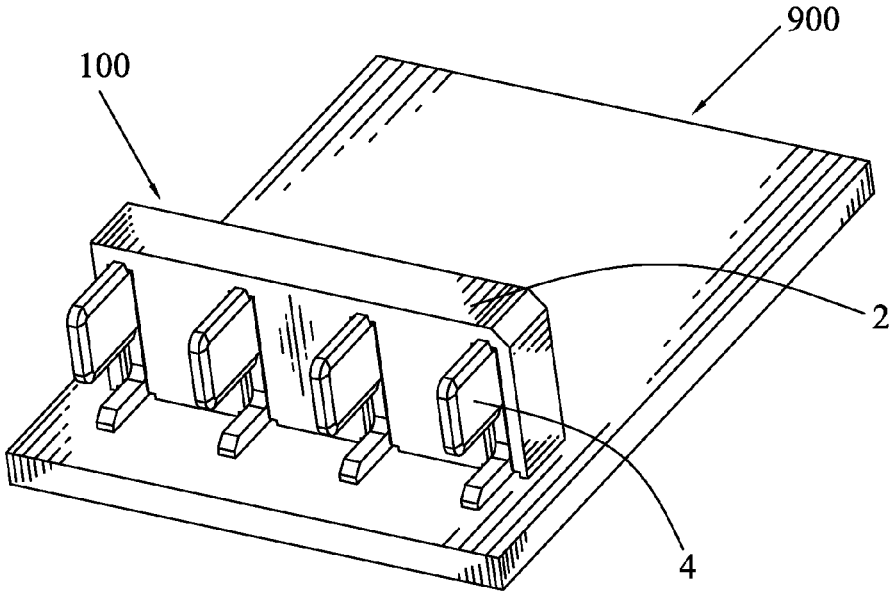
FIG. 3 is a perspective view of a battery connector according to the present invention.
Figure 4:
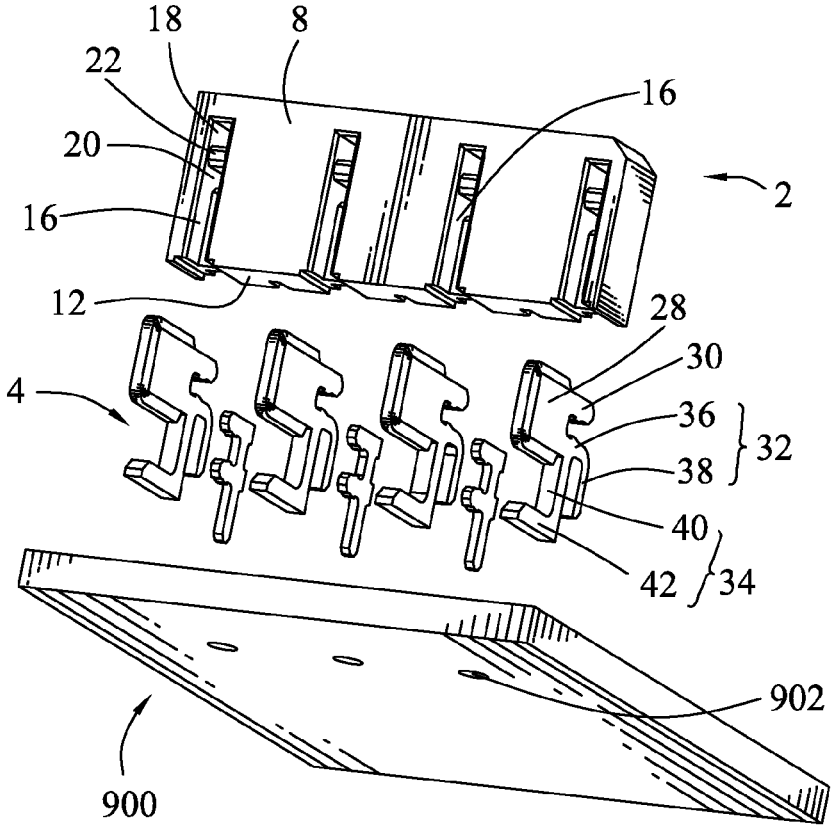
FIG. 4 is an exploded view of the battery connector seen from the front according to the present invention.

Please refer to FIG. 3 and FIG. 4. A battery connector 100 according to the present invention is mounted to a printed circuit board 900. The printed circuit board 900 has a plurality of fixing holes 902. The battery connector 100 has an insulating housing 2, a plurality of contacts 4, and a plurality of fixing terminals 6.

Figure 5:
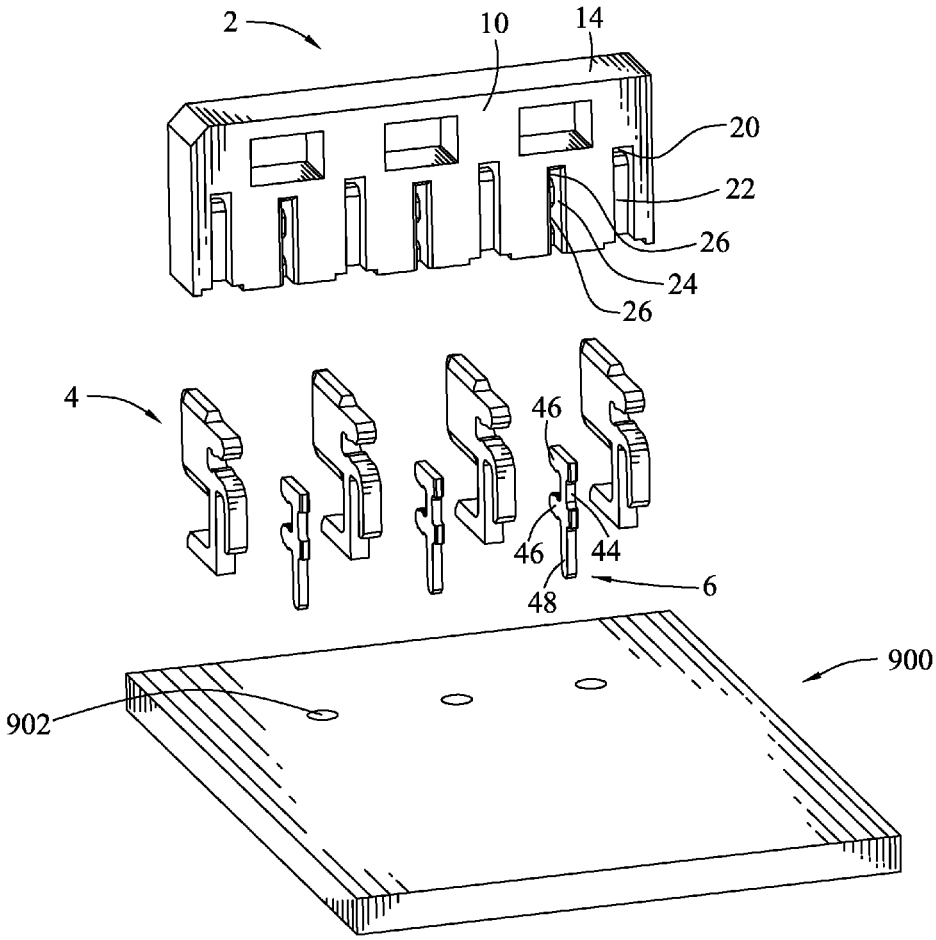
FIG. 5 is an exploded view of the battery connector seen from the rear according to the present invention.

Please refer to FIG. 3 and FIG. 5. The insulating housing 2 is of an elongate shape and transversely mounted on the printed circuit board 900. The insulating housing 2 defines a front surface 8, a rear surface 10 opposite to the front surface 8, a bottom surface 12 and a top surface 14 opposite to the bottom surface 12. The front surface 8 of the insulating housing 2 defines a plurality of first slits 16. The first slits 16 are vertically extended on the front surface 8 of the insulating housing 2. One end of each of the first slits 16 is penetrated the bottom surface 12 and the other end is close to the top surface 14.

A top portion of each of the first slits 16 is horizontally extended a first fixing channel 18 and a through channel 20 below the first fixing channel 18. The first fixing channel 18 and the through channel 20 are extended towards the rear surface 10 and separated from each other by a first rib 22. Especially, the through channel 20 is penetrated the rear surface 10.

The rear surface 10 of the insulating housing 2 defines a plurality of second slits 22 and a plurality of third slits 24. The second slits 22 and the third slits 24 are vertically extended on the rear surface 10 of the insulating housing 2. One end of each of the second slits 22 is connected to the through channel 20 and the other end is penetrated the bottom surface 12.

The second slits 22 and the third slits 24 are staggered. Each of the third slit 24 is formed between two of the second slits 22. One end of each of the third slits 24 is penetrated the bottom surface 12 and the other end is extended to a middle portion of the rear surface 10. Each of the third slits 24 is horizontally extended a pair of second fixing channels 26. The second fixing channels 26 are extended towards the front surface 8 and separated from each other by a second rib.

Each of the contacts 4 has a base board 28, a short strip 30, a long strip 32 and a soldering leg 34. The short strip 30 is horizontally extended from a top end of a rear edge of the base board 28. The long strip 30 has a first fixing section 36 horizontally extended from a bottom end of the rear edge of the base board 28, and a second fixing section 38 extended downwardly from the free end of the first fixing section 36.

Especially, the long strip 30 is of an inverted-L shape. The first fixing section 36 is vertical to the second fixing section 38. The soldering leg 34 has a supporting section 40 extended downwardly from a rear end of a bottom edge of the base board 28, and a foot section 42 horizontally extended from the free end of the supporting section 40.

Especially, the supporting section 40 is vertically extended from the base board 28. The foot section 42 is extended forwardly and below the base board 28. The base board 28 and the foot section 42 of the soldering leg 34 are overlapped along a vertical direction. The soldering leg 34 is of an L shape.

Each of the fixing terminals 6 has a main strip 44, a pair of fixing tabs 46 horizontally extended from a front edge of the main strip 44, and a fixing leg 48 extended downwardly from a bottom edge of the main strip 44.

While the contacts 4 are not yet assembled to the insulating housing 2, the long strip 34 of the contact 4 is straight extended. While the contacts 4 is assembling to the insulating housing 2, first, the contacts 4 are inserted into the first slits 16 from the front surface 8 of the insulating housing 2. The short strip 30 is engaged into the first fixing channel 18 of the insulating housing 2. The long strip 32 is inserted into the through channel 20 and protruded from the rear surface 10 of the insulating housing 2.

The supporting section 40 of the soldering leg 34 is received in the first slit 14. The base board 28 and the foot section 42 of the soldering leg 34 are protruded from the front surface 8 of the insulating housing 2. A bottom edge of the foot section 42 of the soldering leg 34 and the bottom surface 12 of the insulating housing 2 are at the same level.

Second, the long strip 32 of the contact 4 is bended downwardly by an assistant tooling (not show in figures). The first fixing section 36 of the long strip 32 is received in the through channel 20, and the second fixing section 38 is received in the second slit 22. Hence, the contacts 4 can be firmly assembled to the insulating housing 2.

While the fixing terminals 6 are assembled to the insulating housing 2, the fixing terminals 6 are inserted into the third slits 26 of the insulating housing 2 from the rear surface 10. The fixing tabs 46 of the fixing terminal 6 are engaged into the second fixing channels 26. The main strip 44 of the fixing terminal 6 is received in the third slit 24. The fixing leg 48 of the fixing terminal 6 is protruded from the bottom surface 12 of the insulating housing 2.

While the battery connector 100 is mounted to the printed circuit board 900, the bottom surface 12 of the insulating housing 2 and the foot sections 42 of the contacts 4 are mounted on a mounting surface the printed circuit board 900. Hence, the battery connector 100 is applied to surface mount technology (SMT). The fixing legs 48 of the fixing terminals 6 are inserted into the fixing holes 902 respectively for securing the battery connector 100.

Because the first fixing section 36 and the second fixing section 38 of the long strip 32 of the contact 4 are respectively received in the through channel 20 along a horizontal direction and in the second slit 22 along a vertical direction, the contact 4 can be firmly assembled to the insulating housing 2.

Because the foot section 42 of the soldering leg 34 of the contact 4 is extended forwardly and below the base board 28, the weight of the contact 4 is shared and supported by the foot section 42. Because the foot section 42 of the soldering leg 34 of the contact 4 is horizontally mounted on the printed circuit board 900, the contact area between the contact 4 of the battery connector 100 and the printed circuit board can be increased for improving the conductivity therebetween.

Furthermore, the present invention is not limited to the embodiments described above; diverse additions, alterations and the like may be made within the scope of the present invention by a person skilled in the art. For example, respective embodiments may be appropriately combined.

What is claimed is:

1. An electrical connector, comprising:

a housing comprising:

a plurality of first slits vertically formed on a front surface thereof;

a plurality of through channels, each of the through channels extended from each of the first slits and horizontally extended inside the housing, crossed through the housing and penetrated on a rear surface thereof;

a plurality of second slits vertically formed on the rear surface, each of the second slits connected to each of the through channels;

a plurality of third slits vertically formed on the rear surface of the housing, each of the third slits being between two of the second slits; and a plurality of contacts received in the first slits of the housing respectively, each of the contacts comprising:

a base board protruded from the front surface of the housing and being vertically arranged;

a soldering leg extended from a bottom edge of the base board and protruded from the housing;

a first fixing section horizontally extended from a rear edge of the base board and received in each of the through channels of the housing;

a second fixing section vertically extended from a free end of the first fixing section and received in each of the second slits of the housing; and a strip horizontally extended from the rear edge of the base board:

wherein a first fixing channel horizontally extends from each of the first slits towards the rear surface of the housing, each of the first fixing channels and each of the through channels are separated from each other by a first rib, the strip is separated from the first fixing section and engaged into the first fixing channel, a plurality of fixing terminals are engaged into the third slits, respectively, a pair of second fixing channels extend from each of the third slits towards the front surface of the housing, each of the fixing terminals comprises a main strip received in each of the third slits, a pair of fixing tabs horizontally extend from a front edge of the main strip and are respectively engaged into the second fixing channels, and a fixing leg extends downwardly from a bottom edge of the main strip and protrudes from the housing.

2. An electrical connector mounted on a printed circuit hoard formed with a plurality of fixing holes, comprising:

a housing comprising:

a plurality of first slits vertically formed on a front surface thereof;

a plurality of through channels, each of the through channels extended from each of the first slits and horizontally extended inside the housing, crossed through the housing and penetrated on a rear surface thereof;

a plurality of first fixing channels, each of the first fixing channels extended from each of the first slits and towards the rear surface thereof;

a plurality of second slits vertically formed on the rear surface of the housing, each of the second slits connected to each of the through channels;

a plurality of third slits vertically formed on the rear surface of the housing, each of the third slits being between two of the second slits; and a plurality of contacts received in the first slits of the housing respectively, each of the contacts comprising:

a base board protruded from the front surface of the housing and being vertically arranged;

a supporting section extended downwardly and vertically from a rear end of a bottom edge of the base board and received in each of the first slits;

a foot section extended forwardly from a free end of the supporting section and below the base board;

a first fixing section horizontally extended from a bottom end of a rear edge of the base board and received in each of the through channels of the housing; and a second fixing section vertically extended from a free end of the first fixing section and received in each of the second slits of the housing;

wherein the foot section of each of the contacts and a bottom surface of the housing are at the same level to be mounted on the printed circuit hoard, the foot section and the base board are overlapped in a vertical direction, a first fixing channel extends from each of the first slits towards the rear surface of the housing a strip extends from a top end of the rear edge of the base board of each of the contacts for being engaged into the first fixing channel, the first fixing channel and the through channel horizontally extend from a top portion of each of the first slits and are separated from each other by a rib, the through channel is below the first fixing channel, a plurality of fixing terminals are engaged into the third slits, respectively, a pair of second fixing channels extend from each of the third slits towards the front surface of the housing, each of the fixing terminals comprises a main strip received in each of the third slits, a pair of fixing tabs horizontally extend from a front edge of the main strip and are respectively engaged into the second fixing channels, and a fixing leg extends downwardly from a bottom edge of the main strip and protrudes from the housing for being inserted into each of the fixing holes of the printed circuit board.

3. The electrical connector as claimed in claim 2, wherein the housing is elongate and transversely mounted on the printed circuit board.

4. The electrical connector as claimed in claim 3, wherein the first slits are extended from a top portion of the front surface of the housing and penetrated the bottom surface of the housing, the second slits and the third slits are extended from a middle portion of the rear surface of the housing and penetrated the bottom surface of the housing.

* * * * *